US006852939B2

(12) United States Patent
Rhein et al.

(10) Patent No.: US 6,852,939 B2
(45) Date of Patent: Feb. 8, 2005

(54) ELECTRICAL CIRCUIT INTERRUPTING DEVICE

(75) Inventors: David A. Rhein, Columbia, MO (US); Bradley W. Davis, Columbia, MO (US); Michael R. Qualls, Mexico, MO (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 10/759,086

(22) Filed: Jan. 20, 2004

(65) Prior Publication Data

US 2004/0144756 A1 Jul. 29, 2004

Related U.S. Application Data

(62) Division of application No. 10/117,338, filed on Apr. 8, 2002, now Pat. No. 6,753,493.
(60) Provisional application No. 60/294,583, filed on Jan. 1, 2001.

(51) Int. Cl.[7] ..... H01H 33/66
(52) U.S. Cl. ..... 218/154; 218/120
(58) Field of Search ..... 218/153–155, 218/139, 134, 140, 43, 120; 200/400, 401, 50.01, 2, 50.21, 23, 50.26

(56) References Cited

U.S. PATENT DOCUMENTS 4,070,558 A 1/1978 Stewart et al.
4,086,461 A 4/1978 Gonek
4,115,672 A 9/1978 Lipperts
4,124,790 A 11/1978 Kumbera et al.
4,272,687 A * 6/1981 Borkan ..... 307/115
4,323,871 A 4/1982 Kamp et al.
4,381,435 A 4/1983 Barkan
4,503,411 A 3/1985 Lofstrand (List continued on next page.)

*Primary Examiner*—Elvin Enad
*Assistant Examiner*—M. Fishman
(74) *Attorney, Agent, or Firm*—Mark S. Bicks; Alfred N. Goodman

(57) ABSTRACT

A recloser for use with an electrical power distribution system including a circuit interrupter including a primary contact and a movable contact movable relative to the primary contact between a closed position allowing current to pass through the circuit interrupter and an open position separating the contacts and preventing current from passing through the circuit interrupter. An actuator is coupled to the circuit interrupter. The actuator includes a movable shaft coupled to the movable contact of the circuit interrupter for substantially simultaneous movement therewith and without insulation being disposed between the movable contact and the movable shaft. An electronic control is electrically connected to the actuator. The electronic control communicates with the actuator upon occurrence of a fault current to trigger the shaft to move the movable contact of the circuit interrupter from the closed position to the open position and to trigger the shaft to reclose the movable contact from the open position to the closed position upon termination of the fault current.

39 Claims, 6 Drawing Sheets

U.S. PATENT DOCUMENTS 4,506,121 A 3/1985 Peterson et al.
4,527,028 A 7/1985 Luehring
4,562,506 A 12/1985 Moran
4,568,804 A 2/1986 Luehring
4,618,749 A 10/1986 Bohme et al.
4,625,189 A 11/1986 Lazar et al.
4,680,706 A 7/1987 Bray
4,797,777 A 1/1989 Beard
4,798,921 A 1/1989 Watanabe
4,839,481 A 6/1989 Nash et al.
4,879,441 A 11/1989 Hamm et al.
4,935,715 A 6/1990 Popeck
5,055,640 A 10/1991 Lippi et al.
5,099,382 A 3/1992 Eppinger
5,103,364 A 4/1992 Kamp
5,117,325 A 5/1992 Dunk et al.
5,124,678 A 6/1992 Yamat et al.
5,175,403 A 12/1992 Hamm et al.
5,387,772 A 2/1995 Bestel
5,422,450 A 6/1995 Miyazawa et al.
5,452,172 A 9/1995 Lane et al.
5,497,096 A 3/1996 Banting
5,521,348 A 5/1996 Berndt et al.
5,523,536 A 6/1996 Binder et al.
5,597,992 A 1/1997 Walker
5,663,712 A 9/1997 Kamp
5,729,888 A 3/1998 Abdelgawad et al.
5,747,766 A 5/1998 Waino et al.
5,912,604 A 6/1999 Harvey et al.
5,917,167 A 6/1999 Bestel
6,242,708 B1 * 6/2001 Marchand et al. ..... 218/153

* cited by examiner

ELECTRICAL CIRCUIT INTERRUPTING DEVICE

RELATED APPLICATIONS

This application is a divisional of U.S. patent application Ser. No. 10/117,338 filed on Apr. 8, 2002 now U.S. Pat. No. 6,753,493 which claims the benefit of U.S. provisional application Ser. No. 60/294,583 filed on Jan. 1, 2001, the subject matter of each of which is hereby incorporated by reference.

FIELD OF THE INVENTION

The present invention generally relates to a circuit interrupting device used with electrical power distribution systems as protection against a fault current. The circuit interrupting device includes a circuit interrupter and actuator for operating the circuit interrupter with both the circuit interrupter and the actuator being maintained at a potential that is the same as the system potential, allowing for use of less materials and providing a compact design for the device.

BACKGROUND OF THE INVENTION

Conventional circuit interrupting devices, such as circuit breakers, sectionalizers and reclosers provide protection for power distribution systems and the various apparatus on those power distribution systems such as transformers and capacitor banks by isolating a faulted section from the main part of the system. A fault current in the system can occur under various conditions, including but not limited to lightening, an animal or tree shorting the power lines or different power lines contacting each other.

Conventional circuit interrupting devices sense a fault and interrupt the current path. Conventional reclosers also re-close the current path and monitor continued fault conditions, thereby re-energizing the utility line upon termination of the fault. This provides maximum continuity of electrical service. If a fault is permanent, the recloser remains open after a certain number of reclosing operations that can be pre-set.

However, conventional circuit interrupters, particularly reclosers, are heavy and bulky, and are usually supported in a tank that has to be mounted to the utility pole. This also prevents retrofitting a conventional recloser with various circuit interrupter mounts, such as a switch or cutout mounting. Also, conventional reclosers cannot be readily removed from the system to both show a visible break in the circuit and facilitate maintenance on the device. Moreover, the internal mechanisms of conventional reclosers are located within the tank and are thus not visible to a lineman. Therefore, the lineman is forced to rely on an indicator mechanism of the recloser to indicate whether the current path is open or interrupted, and thus, safe for the lineman to perform maintenance or repairs. Moreover, conventional reclosers are costly to make due to the amount and type of materials required. Additionally, conventional reclosers must be grounded, and therefore, require additional amounts of insulative material and ground connections. Furthermore, conventional reclosers often require that the electronic control be housed separately from the recloser.

Also, conventional reclosers require additional mechanical parts to provide a trip free mechanism separate from other mechanisms of the recloser. The trip free mechanism prevents closure of the current path during fault conditions. The additional parts increase costs and require a larger housing to contain the additional parts.

Examples of conventional circuit interrupting devices include U.S. Pat. No. 6,242,708 to Marchand et al.; U.S. Pat. No. 5,663,712 to Kamp; U.S. Pat. No. 5,175,403 to Hamm et al.; U.S. Pat. No. 5,103,364 to Kamp; U.S. Pat. No. 5,099,382 to Eppinger; U.S. Pat. No. 4,568,804 to Luehring and U.S. Pat. No. 4,323,871 to Kamp et al.; the subject matter of each of which is herein incorporated by reference.

SUMMARY OF THE INVENTION

Accordingly, an object of the present invention is to provide a circuit interrupting device that is compact and less expensive than conventional circuit interrupting devices.

Another object of the present invention is to provide a circuit interrupting device that can be retro-fit to various existing circuit interrupter mountings of a power distribution system pole.

A further object of the present invention is to provide a circuit interrupting device that can be easily removed from the system, facilitating maintenance and visually indicating to a lineman that the current path of the system has been interrupted.

Yet another object of the present invention is to provide a circuit interrupting device that is maintained at the same potential as the distribution system.

Still another object of the present invention is to provide a circuit interrupting device that includes an handle and lever mechanism actuated by the electronic control of the device to allow a lineman to manually interrupt the circuit.

Another object of the present invention is to provide a circuit interrupting device that prevents closure of the current path during a fault without the need for separate and additional parts for a trip free mechanism.

The foregoing objects are attained by a circuit interrupting device for use with an electrical power distribution system, comprising a circuit interrupter that includes a primary contact and a movable contact movable relative to the primary contact between a closed position allowing current to pass through the circuit interrupter and an open position separating the contacts and preventing the current from passing through the circuit interrupter. An actuator is coupled to the circuit interrupter. The actuator includes a shaft coupled to the movable contact of the circuit interrupter for substantially simultaneous movement without insulation being disposed between the shaft and the movable contact. The shaft moves the movable contact from the closed position to the open position upon occurrence of a fault current. An electronic control is electrically connected to the actuator and communicating with the actuator to trigger the shaft to move the movable contact of the circuit interrupter from the closed position to the open position.

The foregoing objects are also attained by a circuit interrupting device for use with an electrical power distribution system, comprising a circuit interrupter that has a closed position allowing current to pass through the circuit interrupter and an open position preventing the current from passing through the circuit interrupter. An actuator is coupled to the circuit interrupter. The actuator moves the circuit interrupter between the closed and open positions upon occurrence of a fault current. First and second terminals are electrically connected to the circuit interrupter and are adapted for electrical connection to the power distribution system. A current path is defined between the first terminal, the circuit interrupter, and the second terminal, allowing current of the power distribution system to pass through the current path so that the potential of the circuit interrupter is the same as the potential of the power distribution system. The circuit interrupter and the actuator are not mounted in a grounded container, and the first terminal, the circuit interrupter, the actuator, and the second terminal are ungrounded.

The foregoing objects are also attained by a circuit interrupting assembly for an electrical power distribution system, comprising a first insulator adapted for connection to the power distribution system. The insulator has a first conductive bracket. A circuit interrupting device is coupled to the first conductive bracket of the insulator. The circuit interrupting device includes a circuit interrupter that includes a dielectric housing with a primary contact and a movable contact enclosed therein. The movable contact is movable relative to the primary contact between a closed position allowing current to pass through the circuit interrupter and an open position separating the contacts and preventing current from passing through the circuit interrupter. An actuator is coupled to and disposed adjacent to the circuit interrupter. The actuator is received in a housing and includes a shaft coupled to the movable contact of the circuit interrupter for substantially simultaneous movement without insulation being disposed between the shaft and the movable contact. The shaft moves the circuit interrupter between the closed and open positions upon occurrence of a fault current. First and second terminals are electrically connected to the circuit interrupter. At least one of the first and second terminals is connected to the first conductive bracket. A current path is defined between the first terminal, the circuit interrupter and the second terminal, allowing current of the power distribution system to pass through the current path so that the potential of the circuit interrupter is the same as the potential of the power distribution system. The circuit interrupter and the actuator are not mounted in a grounded container. The first terminal, the circuit interrupter, the actuator, and the second terminal are ungrounded.

The foregoing objects are also attained by a recloser for use with an electrical power distribution system, comprising a circuit interrupter including a primary contact and a movable contact movable relative to the primary contact between a closed position allowing current to pass through the circuit interrupter and an open position separating the contacts and preventing current from passing through the circuit interrupter. An actuator is coupled to the circuit interrupter and includes a movable shaft coupled to the movable contact of the circuit interrupter for substantially simultaneous movement therewith and without insulation being disposed between the movable contact and the movable shaft. An electronic control is electrically connected to the actuator. The electronic control communicates with the actuator upon occurrence of a fault current to trigger the shaft to move the movable contact of the circuit interrupter from the closed position to the open position and to trigger the shaft to reclose the movable contact from the open position to the closed position upon termination of the fault current.

The foregoing objects are also attained by a recloser for use with an electrical power distribution system, comprising a circuit interrupter movable between a closed position allowing current to pass through the circuit interrupter and an open position preventing current from passing through the circuit interrupter. An actuator is coupled to the circuit interrupter and moves the circuit interrupter between the closed and open positions. A rotatable handle mechanism coupled to the actuator and movable between first and second positions corresponding to the closed and open positions of the circuit interrupter and adapted to move the actuator from the closed position to the open position. An electronic control is electrically connected to each of the actuator and the handle mechanism. The electronic control triggers the actuator to move the circuit interrupter from the closed position to the open position and triggers the handle mechanism to rotate from the first position to the second position. During fault conditions the electronic control triggers the actuator to move the circuit interrupter from the closed position to the open position and triggers the handle mechanism to rotate from the first position to the second position with the handle mechanism being incapable of moving the actuator from the open position back to the closed position.

By designing the circuit interrupter in the manner described above, the circuit interrupting device can be made lightweight and compact for removable mounting in various circuit interrupter mountings of a power distribution system. The device also provides a visual indication to a lineman of whether the circuit of the system has been interrupted in the lock-out condition.

Other objects, advantages and salient features of the invention will become apparent from the following detailed description, which, taken in conjunction with annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
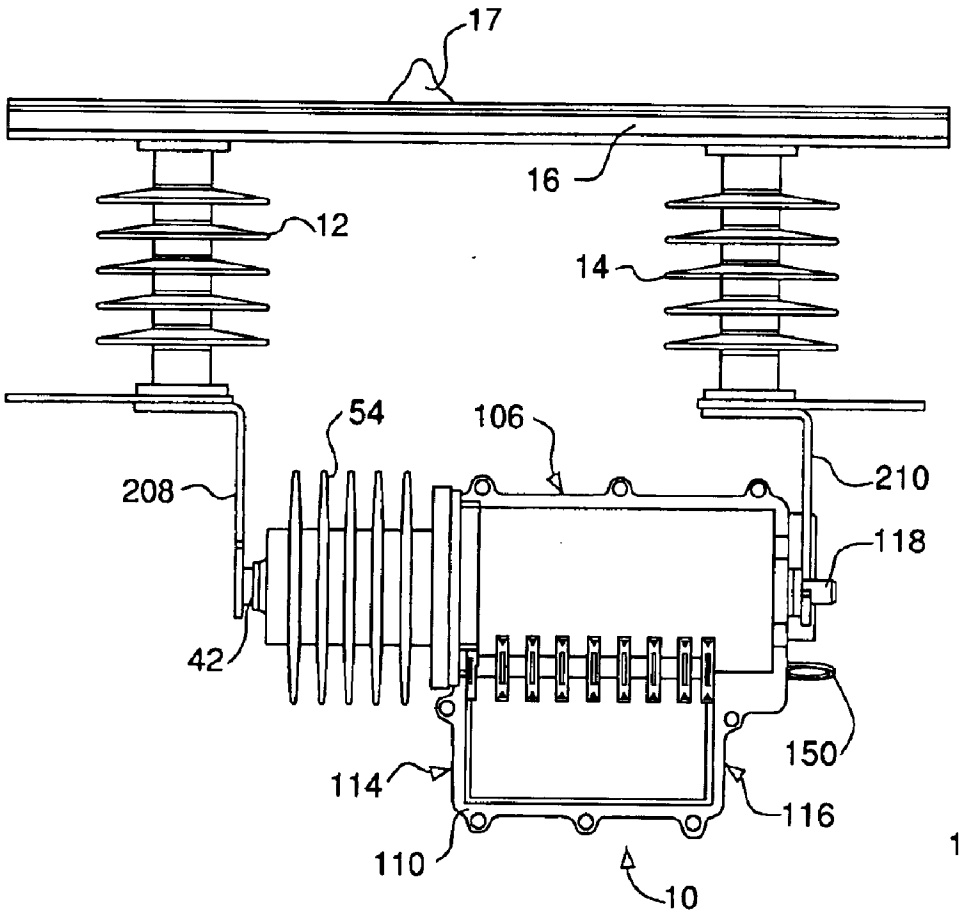
FIG. 1 is a front elevational view of a circuit interrupting device in accordance with an embodiment of the present invention, showing the circuit interrupting device mounted between insulator posts of an electrical power distribution system.

Referring to FIGS. 1–14, a circuit interrupting device 10 for a power distribution system in accordance with an embodiment of the present invention is supported by first and second insulator posts 12 and 14 mounted to a power distribution base 16 attached to cross arm or pole 17 of the system to permit electrically connecting the circuit interrupting device 10 to the system. Preferably, circuit interrupting device 10 is used with a high voltage power distribution system, but can also be used in low voltage applications. Circuit interrupting device 10 generally includes a circuit interrupter 18 actuated by an actuator 20, which is electrically controlled by an electronic control assembly 22. Circuit interrupter 18 is preferably a vacuum interrupter, but can be any type of interrupter such as SF6 gas interrupter or a solid dielectric interrupter. Actuator 20 is preferably a solenoid, but can be any known electrical or mechanical actuating or operating mechanism. Circuit interrupting device 10 is maintained at the same potential as the distribution system by not grounding device 10 to earth ground, thereby eliminating the need for traditional grounded enclosures and additional insulation. Also, circuit interrupting device 10 is exposed and is not received in an outer container that is grounded, such as in an oil or gas filled tank. The reduction in insulative materials significantly reduces costs and provides a compact and lighter circuit interrupting device 10 than conventional devices. The compact design also allows circuit interrupting device 10 to be mounted with various circuit interrupter mountings or be retrofitted to various existing circuit interrupter mountings of the system. For example, device 10 is preferably mounted between insulator posts 12 and 14 of a standard switch mounting but can also be mounted to any suitable mounting, such as a standard cutout or sectionalizer mounting. Circuit interrupting device 10 is preferably a recloser; however, circuit interrupting device 10 can also be a circuit breaker that does not reclose.

Figure 4:
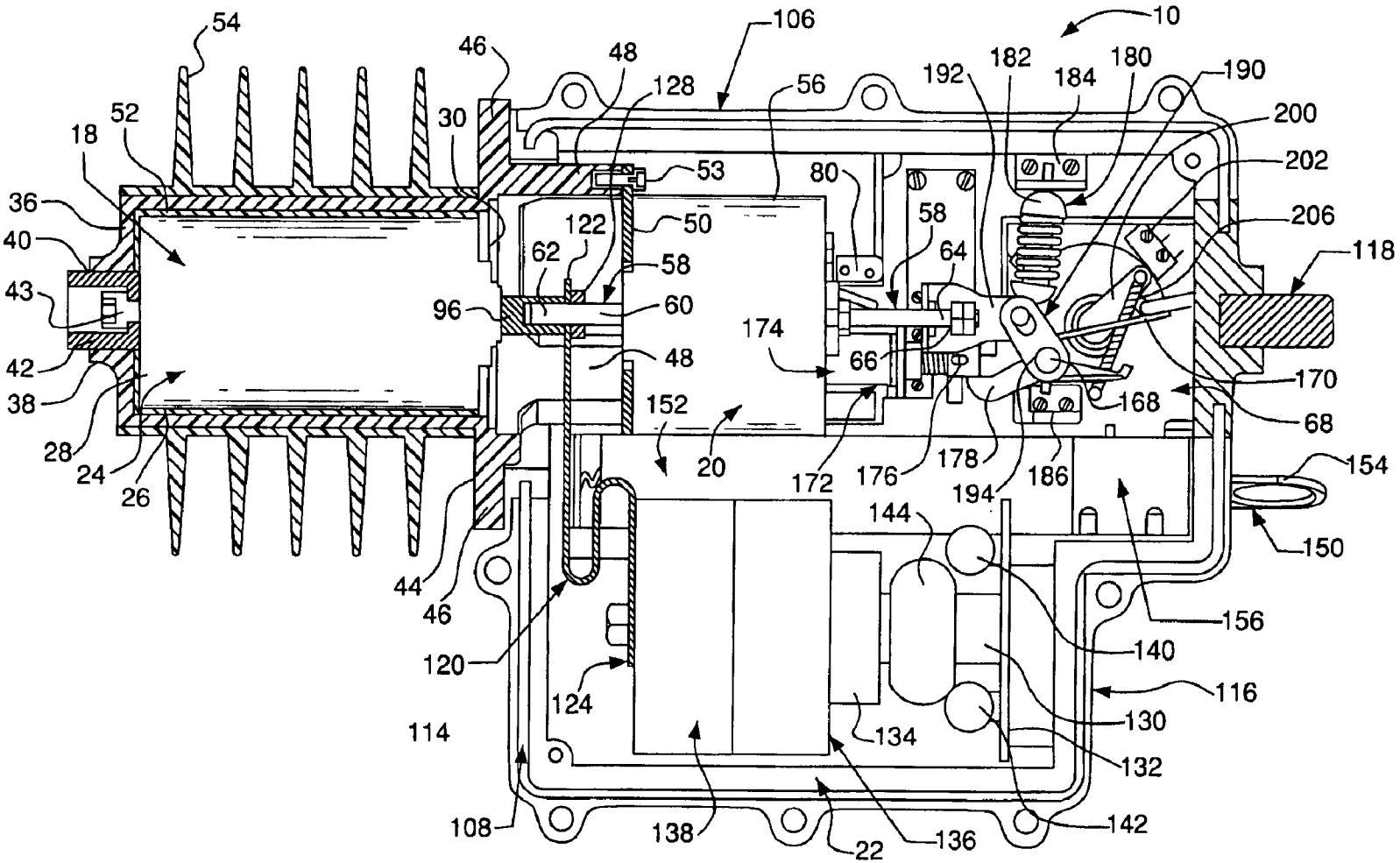
FIG. 4 is a sectional, front elevational view of the circuit interrupting device illustrated in FIG. 1, showing a vacuum interrupter, solenoid, electronic control and handle and lever mechanism assembly of the circuit interrupting device.
Figure 5:
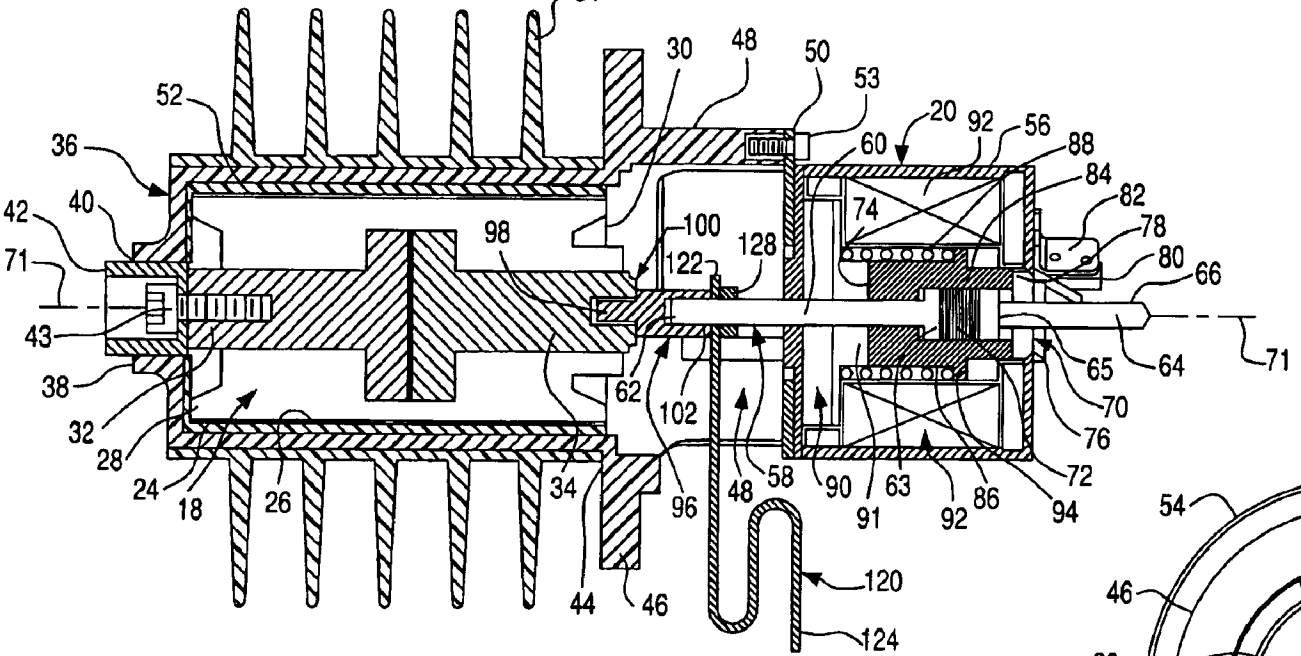
FIG. 5 is a sectional, front elevational view of the vacuum interrupter and the solenoid of the circuit interrupting device illustrated in FIG. 1.

As seen in FIGS. 4 and 5, circuit interrupter or vacuum interrupter 18 is conventional and therefore will only be described in sufficient detail to allow one of ordinary skill in the art to make and use the present invention. Vacuum interrupter 18 provides voltage switching and generally includes a vacuum bottle 24 having a ceramic outer shell 26 with first and second opposing ends 28 and 30. A stationary or primary contact 32 is fixed at first end 28 and a movable contact 34 is slidably supported in an opening at second end 30. A seal (not shown) can be provided to ensure a vacuum is maintained in vacuum bottle 24. Contacts 32 and 34 are preferably made of a conductive material, such as copper. Vacuum is defined as being substantially evacuated of air. The movable contact 34 is connected to and operated by actuator or solenoid 20. As seen in FIG. 5, when stationary and movable contacts 32 and 34 are in contact, vacuum interrupter 18 is in the closed position and circuit interrupting device 10 is operating under normal conditions. During a fault, movable contact 34 is separated from stationary contact 32, typically by only about a fraction of an inch, e.g. about 9 mm, to an open position, thereby interrupting the current path and isolating the fault current.

Vacuum interrupter 18 should meet certain minimum requirements for industry standards. For example, when used in a recloser application, vacuum interrupter 18 should meet industry standards outlined in for example ANSI/IEEE C37.60 for reclosers.

Figure 6:
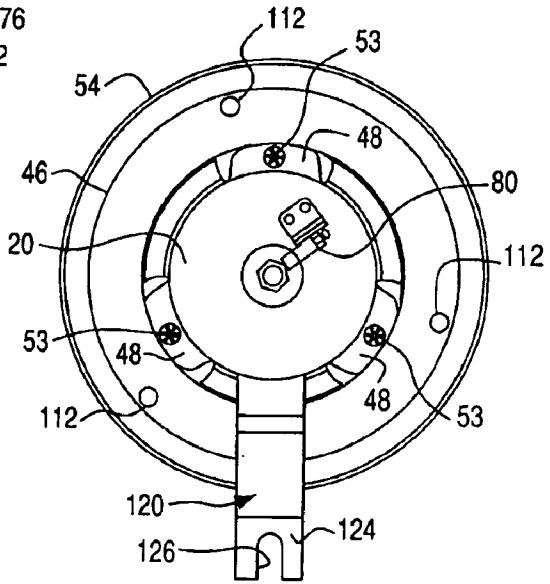
FIG. 6 is a side elevational view of the vacuum interrupter and the solenoid of the circuit interrupting device illustrated in FIG. 1.

Vacuum interrupter 18 is supported by a dielectric housing 36 preferably made of a glass filled polyester. Housing 36 is a unitary one-piece member that is hollow and generally cylindrical in shape to accommodate vacuum interrupter 18. A first end 38 of housing 36 includes an opening 40 for receiving a conductive insert or first terminal 42 molded into opening 40 of housing 36. A bolt 43 extends through insert 42 into vacuum interrupter stationary contact 32 thereby connecting insert 42 to vacuum interrupter 18. Insert 42 provides a mechanism for electrically connecting stationary contact 32 and vacuum interrupter 18 directly or indirectly to the power distribution system. At a second end 44, opposite first end 38, housing 36 includes a radial support plate 46 for rigidly coupling vacuum bottle 24 and solenoid 20. Radial support plate 46 preferably includes three leg extensions 48, as seen in FIGS. 5 and 6, that connect to a mounting plate 50 via fasteners 53 for mounting solenoid 20 to radial support plate 46. Mounting plate 50 can either be fastened to solenoid 20, such as by screws (not shown), or made unitary with solenoid 20.

Between vacuum bottle 24 and dielectric housing 36 is a dielectric filler 52 that fills the space therebetween, thereby replacing the lower dielectric strength air with a higher dielectric material. In particular, filler 52 is a dielectric material that bonds to all contact surfaces ensuring an arc track resistant surface interface. Filler 52 can be any dielectric material such as a dielectric epoxy, polyurethane, a silicone grease or solid. Preferably, filler 52 is room temperature curable and has an acceptable pot life to allow ease in manufacturing. Filler 52 preferably has a very low viscosity to enable the manufacturing and assembly process to be done without using a vacuum.

Weathershed insulation 54 is disposed around the outside of dielectric housing 36 to provide dielectric strength and weatherability to vacuum interrupter 18. Preferably, weathershed insulation 54 is made of a rubber material, such as rubber, EPDM, silicone or any other known material. Alternatively, weathershed 54 and dielectric housing 36 can be formed as a unitary housing made of a dielectric epoxy material.

As seen in FIGS. 4 and 5, solenoid 20 is a latching or bistable mechanism that moves movable contact 34 between and holds it in the open and closed positions with respect to stationary contact 32. Since circuit interrupting device 10 is at the same potential as the system, solenoid 20 can be directly connected adjacent to vacuum interrupter 18. Solenoid 20 includes a generally cylindrical housing 56 with a longitudinal shaft 58 received therein. Shaft 58 includes a first part 60 with a first connection end 62 for connecting to vacuum interrupter movable contact 34 and an opposite end 63 without any insulation therebetween. A second part 64 of shaft 58 includes a second connection end 66 remote from first connection end 62 for connecting to a manual handle and lever mechanism assembly 68, described below, for manually opening and closing vacuum interrupter 18 and an opposite end 65.

Also received within cylindrical housing 56 is an actuating block 70 that is generally cylindrical and receives ends 63 and 65 of first and second parts 60 and 64, respectively, of shaft 58 within an inner bore 72. Actuating block 70 includes a first end 74 with end 63 of shaft first part 60 extending therethrough into inner bore 72. End 65 of shaft second part 64 extends through a second end 76 opposite first end 74 and into inner bore 72. Block second end 76 also includes a shoulder 78 that engages position limit switch 80 supported by bracket 82 for conveying the position of shaft 58 and vacuum interrupter 18, either opened or closed, to electronic control assembly 22 as block 70 slidably moves along a longitudinal axis 71 within solenoid 20. A first biasing member 84 is disposed in inner bore 72 between ends 63 and 65 of shaft first and second parts 60 and 64. First biasing member 84 is preferably a plurality of Belleville washers. Shaft first part 60 is trapped between vacuum interrupter movable contact 34 and first biasing member 84 of actuator block 70. Shaft second part 64 screws into actuating block inner bore 72 with end 65 to adjust the load applied by first biasing member 84 on shaft first part 60 by increasing or decreasing the load applied to biasing member 84 by end 65 of shaft second part 64. This allows selection of the appropriate amount of load to ensure the proper connection between shaft first part 60 and movable contact 34 and thus between vacuum interrupter stationary and movable contacts 32 and 34.

Disposed around the outer surface 86 of support block 70 is a second biasing member 88 which is preferably a compression spring. A permanent magnet 90, preferably any rare earth magnet, abuts actuating block first end 74, and holds actuating block 70 toward magnet 90 forcing shaft first part 60 and movable contact 34 against stationary 32 in the vacuum interrupter closed position. A radial lip 94 of actuating block 70 compresses spring 88, as seen in FIG. 5. The permanent magnet 90 and flux concentrator 91 allow the solenoid 20 to hold the vacuum interrupter contacts 32 and 34 closed without power. An energy coil 92 surrounds actuator block 70 and spring 88. Coil 92 creates an opposing magnetic force to magnet 90, releasing spring 88 and actuator block 70 away from magnet 90 when energized by electronic control assembly 22 in a first direction. In particular, spring 88 abuts radial lip 94 of actuating block 70 to force block 70 away from magnet 90 and vacuum interrupter 18. This in turn moves movable contact 34 away from stationary contact 32 to the open position. Coil 92 can also create a magnetic force in the same direction as magnet 90 which overcomes spring 88 and moves contact 34 back to the closed position when energized by electronic control assembly 22 in a second direction opposite the first direction.

As seen in FIGS. 4 and 5, vacuum interrupter 18 and solenoid 20 are coupled by a conductive adapter 96. Specifically, a first end 98 of adapter 96 is threadably received into an end 100 of vacuum interrupter movable contact 34, and an opposite end 102 threadably receives connection end 62 of shaft first part 60 of solenoid 20. This provides a continuous conductive path between vacuum interrupter movable contact 34 and solenoid shaft first part 60 without any insulation being disposed between movable contact end 100 and shaft connection end 62. Alternatively, shaft first part 60 can be extended and threadably received directly into movable contact end 100. The conductive connection of vacuum interrupter movable contact 34 and solenoid shaft first part 60 without insulation allows placement of solenoid 20 in close proximity with or adjacent to vacuum interrupter 18 resulting in a more compact design of device 10.

Solenoid 20 is received within a housing 106, as best seen in FIG. 4. Housing 106 includes first and second halves 108 and 110 shaped to accommodate solenoid 20 with vacuum interrupter 18 connected to housing 106 by radial support plate 46 of dielectric housing 36. In particular, radial support plate 46 includes a plurality of threaded holes 112, which may include threaded inserts (not shown), as best seen in FIG. 6, that align with holes (not shown) of housing 106. Fasteners (not shown) extend through holes 112 of radial support plate 46 and the holes of conductive housing 106. Leg extensions 48 of radial support plate 46 extend through an opening in a first side 114 of housing 106 so that radial support plate 46 abuts side 114 thereby closing off the opening.

A second side 116 of housing 106 opposite side 114 and dielectric housing 36 includes a conductive extension or second terminal 118. Preferably, housing 106 is made of a conductive material forming part of the electrical connection between second terminal 118 and first terminal 42. Housing 106 can be made of any conductive material such as aluminum. Alternatively, housing 106 can be made of a non-conductive material, such as plastic, or a poor conductive material, such as stainless steel, with a conductive shunt (not shown) connected to second terminal 118 and electrically connected indirectly to first terminal 42.

As seen in FIG. 4, also received within housing 106 and electrically connected to solenoid 20 by wiring is electronic control assembly 22, as best seen in FIG. 4. Electronic control assembly 22 will sense a fault current and trigger solenoid 20 to open vacuum interrupter 18. A flexible conductive strap 120, preferably formed of thin copper ribbons, directs the current from vacuum interrupter 18 to electronic control 22 and substantially prevents the current from going through solenoid 20. Strap 120 includes opposite first and second ends 122 and 124 and each end having an opening or cutout 126, as seen in FIG. 6 (showing only second end 124 with cutout 126). First end 122 of strap 120 is coupled to vacuum interrupter 18 and solenoid 20 at adapter 96. In particular, strap first end 122 is sandwiched between adapter 96 and a nut 128 with shaft first part 60 extending through the cutout of strap first end 122.

Second end 124 of strap 120 is coupled to a conductive support tube 130 of electronic control 22. Support tube 130 is preferably made of copper, and is attached to and electrically connected to an electronics board 132. Support tube 130 also supports a sensor or sensing current transformer 134 that measures current amplitude, and first and second power transformers 136 and 138 with each transformer being electrically connected to electronics board 132 by wiring. Sensing current transformer 134 is used to monitor the magnitude of the system current. First power current transformer 136 is used to charge a first capacitor 140 of electronics board 132 which stores energy from the system to power device 10 and to trip the solenoid 20 and vacuum interrupter 18 to the open position. Second power current transformer 138 is used to charge a second capacitor 142 similar to first capacitor 140 which stores the energy to trip solenoid 20 and vacuum interrupter 18 closed. Although it is preferable to use two power current transformers, one power current transformer can be used. A clamp 144 is disposed on support tube 130 that clamps electronic control assembly 22 to housing 106. Tube 130 defines a current path from electronic control 22 to second terminal 118 of housing 106. If housing 106 is made of a non-conductive or poor conductive material, a conductive shunt (not shown) can be provided between support tube 130 and terminal 118 to define the current path from control 22 to terminal 118.

A battery 150 is preferably used as a power source for electronic control assembly 22 to close vacuum interrupter contacts 32 and 34 when initially installing device 10 and after lock-out of device 10 due to a permanent fault. Battery 150 is also received within housing 106 and removably secured thereto. Battery 150 includes a plastic tube 152 that carries a plurality of lithium batteries and provides a current path through housing 106 to electronics board 132. A ring 154 at the distal end of battery 150 extends outside of conductive housing 106 and provides an attachment point for a tool, such as a hot stick, for installing and removing battery 150. An external power source can be used in lieu of the battery to close the interrupter contacts upon initial installation and lock-out.

Also connected to electronics board 132 and received within housing 106 is a counter mechanism 156, as seen in FIG. 4. Since most fault currents are temporary, a variable time period generally ranging between 0 and 60 seconds, such as for example 4 seconds, is programmed into electronics board 132 of electronic control 22 for closing vacuum interrupter 18, thereby reclosing the current path of the system. However, if a fault current is still detected by electronic control 22 after several operations of solenoid 20 and vacuum interrupter 18, electronic control 22 will maintain vacuum interrupter 18 in an open or lock-out position, thereby isolating the fault current from the rest of the system. A counter mechanism 156 tracks the number of times vacuum interrupter 18 is opened and closed independently of electronic control 22.

As seen in FIGS. 4 and 8–14, manual handle and lever mechanism assembly 68 is coupled to solenoid 20 and received within housing 106. Manual handle and lever mechanism assembly 68 includes an operating handle mechanism 160 and a lock out lever mechanism 162. Operating handle mechanism 160 communicates with electronic control 22, preferably through limit switches, to allow a lineman to open vacuum interrupter 18, if necessary to interrupt the circuit, by manually rotating a handle 164 of handle mechanism 160. Handle 164 will also provide a visual indication of when device 10 and contacts 32 and 34 are closed or in permanent lock-out. Lock-out lever mechanism 162 allows the lineman to prevent electronic control 22 from signaling solenoid 20 and vacuum interrupter 18 to reclose after a fault current has been detected by manually rotating a lever 166 of lever mechanism 162. This is particularly useful when the lineman is testing or performing maintenance on the system to prevent reclosure while work is being performed. Handle mechanism 160 and lever mechanism 162 operate independently of one another.

Figure 8:
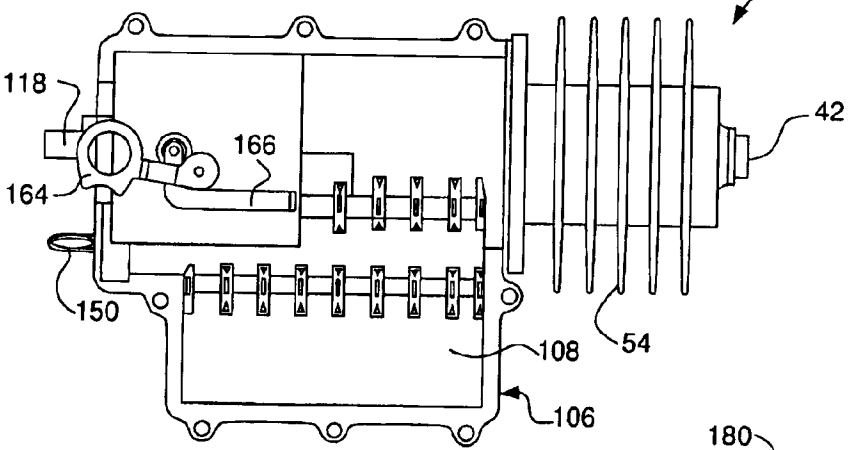
FIG. 8 is a rear elevational view of the circuit interrupting device illustrated in FIG. 1, showing a handle mechanism and a lever mechanism of the handle and lever mechanism assembly in the closed and normal positions, respectively.
Figure 11:
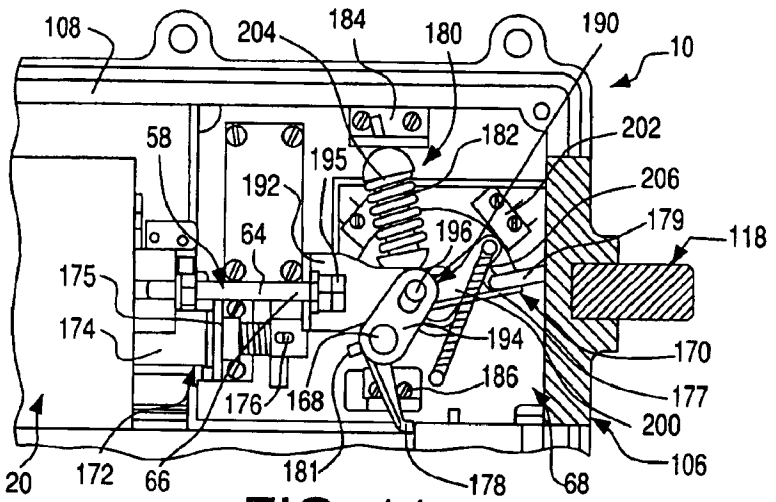
FIG. 11 is a partial, sectional, front elevational view of the handle and lever mechanism assembly of the circuit interrupting device illustrated in FIG. 4, showing the handle mechanism opened by the electronic control and the lever mechanism in the normal position.

Handle mechanism 160 includes handle 164 connected to a rotatable shaft 168 which supports a drive spring 170 that is loaded when handle 164 is in the normal or closed position, as seen in FIG. 8. Drive spring 170 is preferably a double torsion spring. Mechanism 160 also includes a secondary solenoid assembly 172 supported by a bracket 175 (seen in FIGS. 9 and 10). When secondary solenoid assembly 172 is stimulated by electronic control 22 that fault conditions are present and permanent (i.e. not temporary), solenoid assembly 172 releases the stored energy in drive spring 170 to move handle 164 about seventy degrees downwardly to the open position indicating that vacuum interrupter 18 is in the open position. In particular, solenoid assembly 172 includes a solenoid 174 and a retainer block 176 which operates with a lever 178 coupled to shaft 168. Lever 178 restrains and releases the stored energy of drive spring 170 to handle shaft 168. Arms 177 of spring 170 are retained by a plate 179 (seen in FIGS. 11–14) extending from the housing first half 108 inner surface. A pin 181 catches lever 178 to rotate lever 178 and shaft 168 to the open position. Shaft 168 also supports an over toggle spring assembly 180 including a compression spring 182 and support bracket 184, which maintains the handle 164 in either the opened or closed position. Drive spring 170 will overcome compression spring 182 when electronic control 22 signals a permanent fault condition. A switch 186 attached to the inner surface of housing half 108 is triggered by cam 188 that is disposed on handle shaft 168 thereby communicating the open or closed position of handle 164 to electronic control 22.

Alternatively, a lineman can manually open vacuum interrupter 18 to interrupt the circuit, if for example electronic control 22 fails to signal solenoid 20 to open vacuum interrupter 18 (i.e. due to malfunction). In particular, bracket assembly 190 operates with handle shaft 168 to mechanically open vacuum interrupter 18 when handle 164 is moved or rotated downwardly by the lineman. Bracket assembly 190 includes a U-shaped bracket 192 rotatably coupled to extensions 194 by a pin 196. Extensions 194 are fixed to handle shaft 168. U-shaped bracket 192 is slidably coupled to solenoid shaft second part 64 allowing shaft second part 64 to move relative to bracket 192 when moving vacuum interrupter contacts 32 and 34 between the opened and closed positions by solenoid 20. At least one nut or catch 195 is disposed at shaft connection end between U-shaped bracket 192 and pin 196 to engage U-shaped bracket 192 for mechanically pulling solenoid shaft 58 and actuator block 70 in response to the lineman rotating the handle which in turn pulls vacuum interrupter movable contact 34 out of contact with stationary contact 32 when the electronic control is inoperative.

Figure 9:
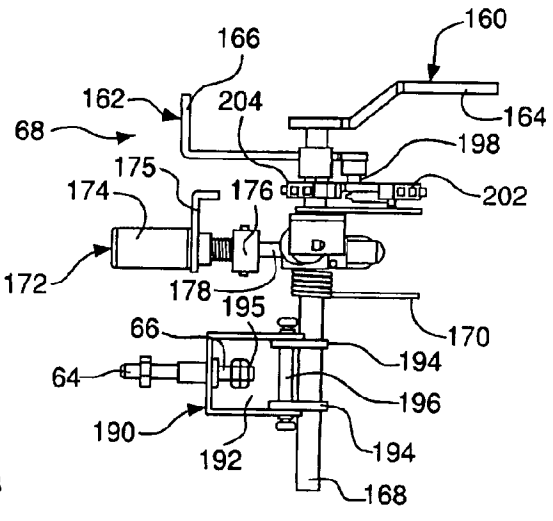
FIG. 9 is a top plan view of the handle and lever mechanism assembly of the circuit interrupting device illustrated in FIG. 1, showing the handle and lever mechanisms in the closed and normal positions, respectively.
Figure 10:
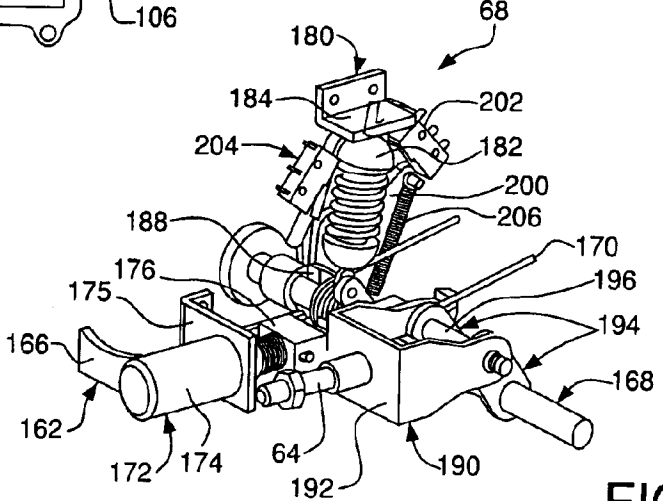
FIG. 10 is a perspective view of the handle and lever mechanism assembly of the circuit interrupting device illustrated in FIG. 9.

As seen in FIGS. 8–10, lock-out lever mechanism 162 includes lever 166 connected to a rotatable shaft 198 separate from handle shaft 168. Lever shaft 198 supports a lever 200 that trips either switch 202 when lever 166 is in the normal position or switch 204 when lever 166 is in the lock-out position. Switches 202 and 204 are attached to the inner surface of housing half 108. Lever 166 is in the normal position, as seen in FIG. 8, when vacuum interrupter 18 is in the closed position and electronic control 22 is operating under normal reclose conditions. Lever 166 is in the lock-out position when lever 166 is rotated by the lineman to signal electronic control 22 to lock-out and not attempt a reclose after fault conditions have been detected. An over-toggle spring 206 is coupled to lever 200 to maintain lever 166 in either the normal or lock-out positions.

Assembly

Referring to FIGS. 1–14, circuit interrupting device 10 is assembled by rigidly coupling vacuum interrupter 18 and solenoid 20 using adapter 96. Specifically, adapter first end 98 is threaded into the end 100 of vacuum interrupter movable contact 34 and connection end 62 of solenoid shaft first part 60 is threaded into adapter second end 102. Solenoid 20 will be adjacent vacuum interrupter 18 and no insulation is placed in the connection between movable contact 34 and shaft first part 60 since circuit interrupting device 10 will be maintained at system potential and not grounded. This allows for a compact design of circuit interrupting device 10. Also, mounting plate 50 attached to solenoid 20 is mounted to leg extensions 48 of radial support plate 46 of vacuum interrupter dielectric housing 36 via fasteners 53, such as screws.

Vacuum interrupter 18 is electrically connected to electronic control 22 by strap 120. Electronic control 22 is electrically connected by wiring to solenoid 20 and solenoid limit switch 80. Electronic control 22 is also electrically connected to secondary solenoid 172 and the switches 186, 202 and 204 of handle and lever mechanism assembly 68. Handle mechanism 160 is mechanically coupled to solenoid shaft second part 64 via bracket assembly 190.

Figure 2:
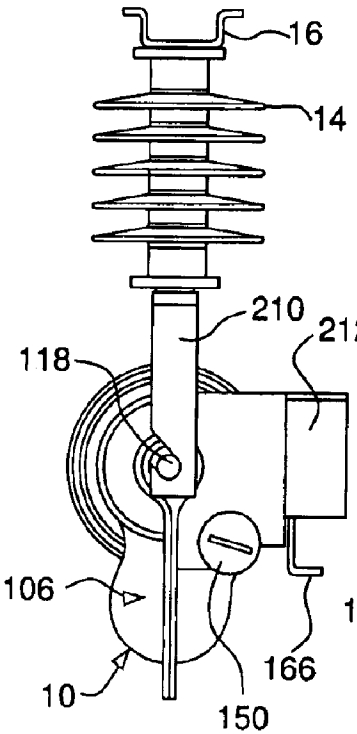
FIG. 2 is a side elevational view of the circuit interrupting device illustrated in FIG. 1.
Figure 3:
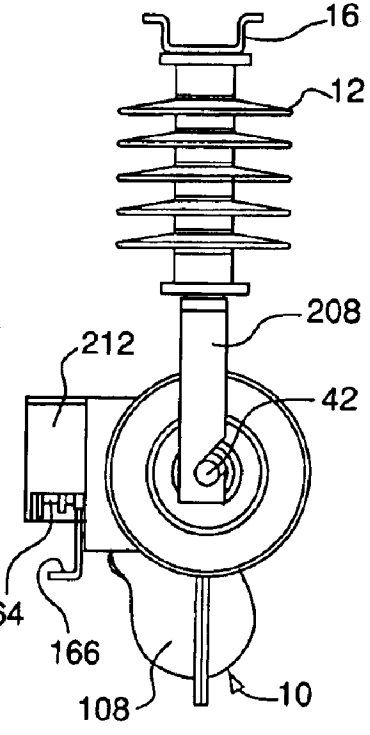
FIG. 3 is a side elevational view of the circuit interrupting device illustrated in FIG. 1.

Dielectric housing 36 is connected to housing 106, with solenoid 20, electronic control 22 and handle and lever mechanism assembly 68 being received within housing 106. In particular, dielectric housing 36 is attached to housing 106 by aligning threaded holes 112 of radial support plate 46 with holes in housing 106 allowing fasteners, such as screws, to be inserted and threaded therein thereby coupling dielectric housing 36 and conductive housing 106. Handle 164 and lever 166 of handle and lever mechanism assembly 68 extend outside of housing 106 and can include a protective cover 212, as seen in FIGS. 2 and 3.

The assembled circuit interrupting device 10 can be mounted in a variety of mountings of the power distribution system as long as first and second terminals 42 and 118 of device 10 are electrically connected to the system. Preferably, circuit interrupting device 10 is mounted between posts 12 and 14 of a conventional switching device (switch not shown). As seen in FIGS. 2 and 3, first and second terminals 42 and 118 are engaged with first and second brackets 208 and 210 of posts 12 and 14, respectively, thereby supporting circuit interrupting device 10 and electrically connecting circuit interrupting device 10 to the system. The engagement of first and second terminals 42 and 118 with brackets 208 and 210, respectively, allow for easy installation of device 10 as well as removal of device 10. This allows a lineman to completely remove circuit interrupting device 10 from the system, such as for maintenance, and once removed also provides a clear visual indication that the circuit has been interrupted.

Movable contact 34 of vacuum interrupter 18 is in the open position when mounting circuit interrupting device 10. Electronic control 22 signals closure of vacuum interrupter contacts 32 and 34 using battery 150 as an initial power source. Once mounted, the current path through device 10 goes through first terminal 42; through stationary and movable contacts 32 and 34 of vacuum interrupter 18; through adapter 96; through tube 130 of electronic control 22 via strap 120; and through housing 106 at clamp 144 to second terminal 118. If housing is nonconductive or of poor conductivity, the current would travel from support tube 130 and then through a conductive shunt to second terminal 118. The current is prevented from going through solenoid 20 by strap 120 and by isolating (i.e. not touching) solenoid 20 from housing 106.

Operation

In operation, electronic control assembly 22 will detect a fault by means of a conventional current transformer sensor, and open contacts 32 and 34 of vacuum interrupter 18. Electronic control 22 will then reclose contacts 32 and 34 after a user defined pre-set length of time. If the fault current is only temporary and has terminated, electronic control 22 will keep vacuum interrupter contacts 32 and 34 closed allowing circuit interrupting device 10 to remain closed and minimize interruption of the circuit. If the fault current is still present, electronic control 22 will again open and reclose vacuum interrupter contacts 32 and 34 for a pre-set number of times. Electronic control 22 tracks the number of reclosings by solenoid 20, and will also reset after the pre-set number of reclose operations have been completed without lock-out or after a selected period of time. Once the pre-set number of reclose attempts is exhausted indicating that the fault condition is permanent, electronic control 22 keeps vacuum interrupter contacts 32 and 34 in the open position, thereby interrupting and isolating the fault from the rest of the system.

Figure 7:
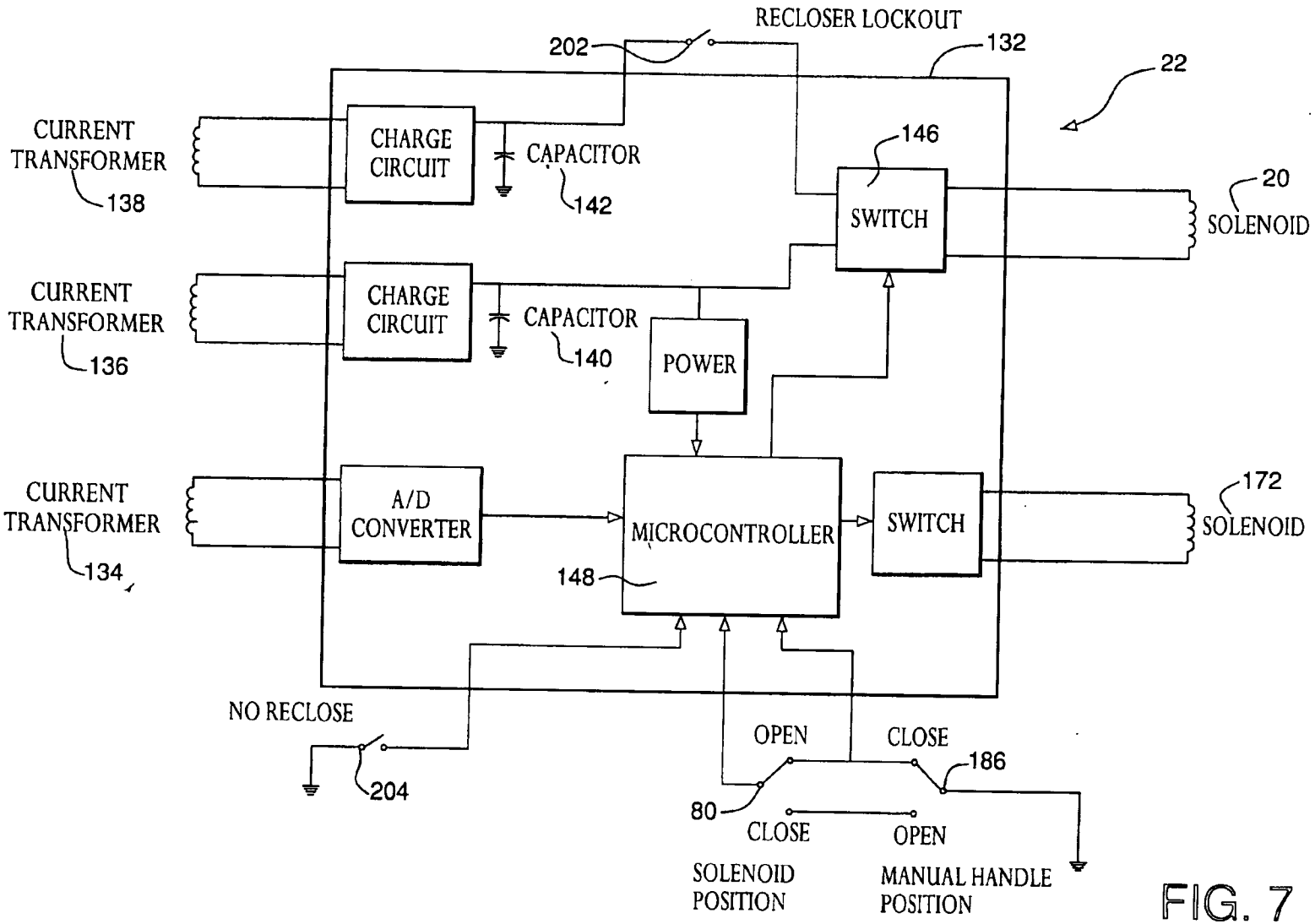
FIG. 7 is a diagrammatic view of the electronic control of the circuit interrupting device illustrated in FIG. 1.

As seen in FIGS. 4 and 7, a fault current is detected by sensing current transformer 134 which signals a microcontroller 148 of electronic control 22 to interrupt the circuit by opening contacts 32 and 34. In particular, as is known in the art, the output current of transformer 134 is converted to a voltage and fed to an A/D converter. The microcontroller 148 uses the output of the A/D converter to determine whether a fault condition exists. The power current transformers 136 and 138 are used to convert the load current or fault current to usable energy. Microcontroller 148 signals switch 146 to switch to first capacitor 140 that has been energized by power current transformer 136. Capacitor 140 provides an energy pulse to coil 92 of solenoid 20 in a first direction that cancels magnetic force of magnet 90 of solenoid 20, thereby releasing compression spring 88 and actuator block 70. Due to the force of spring 88 on actuator block 70, block 70 and shaft 58 will move away from magnet 90 and vacuum interrupter 18. Since first part 60 of shaft 58 is connected to movable contact 34 of vacuum interrupter 18, movable contact 34 will separate from stationary contact 32 to the open position thereby breaking the current path and interrupting the fault.

After a certain period of time, such as a few seconds, programmed into microcontroller 148 of electronic control 22, the second capacitor 142 is triggered via microcontroller 148 and switch 146 to provide an energy pulse in a second direction, opposite the first direction of the first capacitor 140, to coil 92 which creates a magnetic force that overcomes the spring 88 thereby moving actuator block 70 back against magnet 90 and movable contact 34 back into contact with stationary contact 32 to the closed position, thereby reclosing the current path. If after several of these operations, the fault conditions remain, electronic control 22 will trigger solenoid 20 and vacuum interrupter contacts 32 and 34 to remain in the open or lock-out position, thereby permanently isolating the fault from the system.

Microcontroller 148 includes a memory for recording data after a fault has occurred such as the amplitude of the fault current, the duration of the fault current, the number of reclose operations performed, the time of day, and the date. This data can then be downloaded. Preferably, microcontroller 148 continually stores the last 12 events.

Handle and lever mechanism assembly 68 is shown in the normal operating position, as seen in FIGS. 4, and 8–10, when vacuum interrupter contacts 32 and 34 are in the closed position. In this position, handle 164 of handle mechanism 160 is in the closed position or extending horizontally with respect to housing 106 and lever 166 is the normal position or extending horizontally in a direction opposite that of handle 164, as seen in FIG. 8. Drive spring 170 is loaded and restrained by lever 178 and housing plate 179. Lever 178 is restrained under retainer block 176 of secondary solenoid assembly 172. Compression spring 182 of over toggle spring assembly 180 biases handle shaft 168 and handle 164 in the closed position. Also in this position, lever 200 of lever mechanism 162 engages switch 202 which signals electronic control 22 to operate under normal reclose conditions. Over toggle spring 206 biases lever 200 toward switch 202 and lever 166 in the normal position.

Referring to FIG. 1, handle and lever mechanism assembly 68 is shown in a position after a fault current is determined to be permanent and electronic control 22 signaled vacuum interrupter contacts 32 and 34 (seen in FIG. 5) to remain permanently in the open or lock-out position. In this position, electronic control 22 (seen in FIG. 4) signaled solenoid 174 of solenoid assembly 172 to release the stored energy of drive spring 170 by retracting retaining block 176 allowing lever 178 to rotate with respect to handle shaft 168 upwardly toward drive spring 170 to release drive spring 170. Pin 181 engaged lever 178 which in turn rotated handle shaft 168 and handle 164 to the open position (not shown) with handle 164 extending vertically downwardly with respect to housing 106. Compression spring 182 of over toggle spring assembly 180 biases handle shaft 168 and handle 164 in the open position. Cam 188 (seen in FIG. 10) on handle shaft 168 will trigger or engage switch 186 to communicate with electronic control 22 that handle 164 is in the open position. Also, since handle mechanism 160 and lever mechanism 162 (seen in FIGS. 9 and 10) operate independently, lever 166 of lever mechanism 162 is maintained in the normal position, as described above, as seen in FIG. 8.

Figure 12:
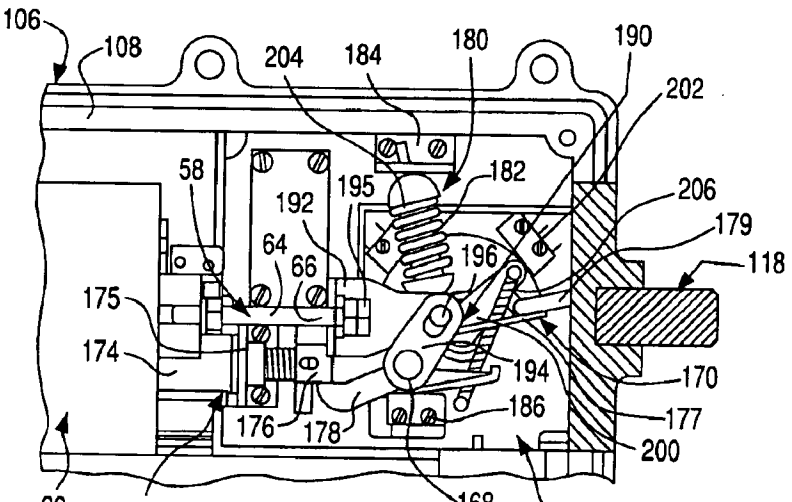
FIG. 12 is a partial, sectional, front elevational view of the handle and lever mechanism assembly of the circuit interrupting device illustrated in FIG. 4, showing the handle mechanism opened manually and the lever mechanism in the normal position.

Referring to FIG. 12, handle and lever mechanism assembly 68 is shown in a position after a lineman has manually moved handle mechanism 160 to the open position by rotating handle 164 downwardly to a vertical position (not shown). Rotation of handle 164 will cause cam 188 on handle shaft 168 (seen in FIG. 10) to trigger switch 186 which communicates with electronic control 22 (seen in FIG. 4) to open solenoid 20 and vacuum interrupter contacts 32 and 34 (seen in FIG. 5). Drive spring 170 remains loaded and lever 178 is retained under retaining block 176 of solenoid assembly 172. If electronic control 22 has malfunctioned, shaft 168 of handle mechanism 160 rotates U-shaped bracket 192 which engages nut or catch 195 (seen in FIG. 9) on shaft connection end 66 to pull shaft second part 64, actuator block 70, and shaft first part 60 of solenoid 20 and separate vacuum interrupter movable contact 34 from stationary contact 32 thereby interrupting the circuit. Also, lever 166 of lever mechanism 162 is maintained in its normal position, as seen in FIG. 8.

As a safety measure, device 10 and handle mechanism 160 are designed to prevent mechanical closure of vacuum interrupter contacts 32 and 34 using handle 164, such as after handle 164 has been moved to the open position either manually or by electronic control 22. Only electronic control 22 can close contacts 32 and 34 and thus close the current path. This prevents a lineman from mechanically closing vacuum interrupter 18, independent of electronic control 22. In particular, an attempted rotation of handle 164 from the open position back to the closed position will not move solenoid shaft second part 64 back towards vacuum interrupter 18 to close contacts 32 and 34 because shaft second part 64 and U-shaped bracket 192 of handle mechanism 160 being slidable in the closing direction since there is not nut or other member to engage bracket 192 and to stop relative movement of the shaft and bracket. In addition to safety, using only electronic control 22 eliminates the need for additional mechanical parts, such as a trip-free mechanism, to allow immediate reopening of vacuum interrupter 18 in the presence of a fault regardless of the lineman's manipulation of the handle. Elimination of these parts allows for a less expensive and more compact design.

Figure 13:
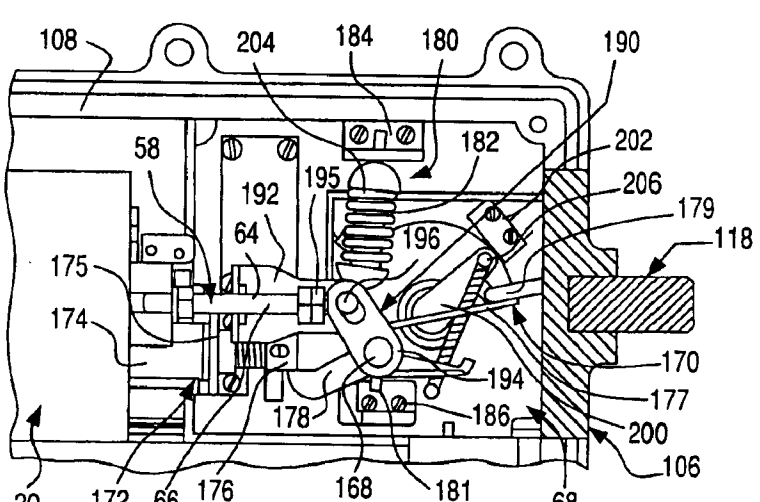
FIG. 13 is a partial, sectional, front elevational view of the handle and lever mechanism assembly of the circuit interrupting device illustrated in FIG. 4, showing the handle mechanism in the closed position during reclose and the lever mechanism in the normal position.

Referring to FIG. 13, handle and lever mechanism assembly 68 is shown in a position when electronic control 22 (seen in FIG. 4) has detected a fault current and has opened solenoid 20 and vacuum interrupter contacts 32 and 34 (seen in FIG. 5) and is in the middle of reclosing vacuum interrupter 18. During reclose, the fault current is considered temporary and therefore electronic control 22 does not signal solenoid assembly 172 to open handle mechanism 160. In other words, handle 164 of handle mechanism 160 is maintained in the closed position, as seen in FIGS. 8-10 while reclose operations are being performed. Solenoid shaft 58 and actuating block 70 are allowed to move back and forth along longitudinal axis 71 (seen in FIG. 5) to open and reclose vacuum interrupter contacts 32 and 34 without interference from handle mechanism 160. In particular, solenoid shaft second part 64 slides with respect to U-shaped bracket 192. Lever 166 of lever mechanism 162 is also maintained in its normal position, as seen in FIG. 8. If the pre-set number of reclose attempts are exhausted, electronic control 22 will then maintain solenoid 20 and vacuum interrupter 18 in the open position and signal solenoid assembly 172 to move handle 164 of handle mechanism 160 to the open position (not shown) as described above. Lever 166 will still remain in the normal position.

Figure 14:
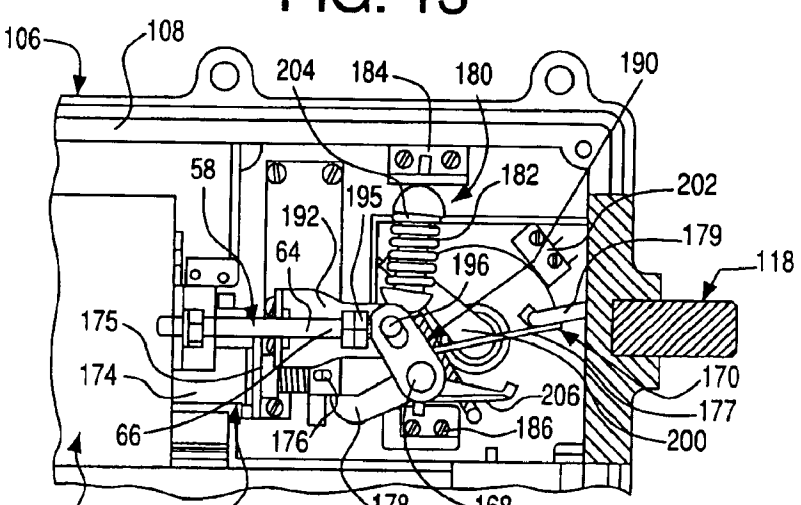
FIG. 14 is a partial, sectional, front elevational view of the handle and lever mechanism assembly of the circuit interrupting device illustrated in FIG. 4, showing the handle mechanism in the closed position and the lever mechanism in the lock-out position.

Referring to FIG. 14, handle and lever mechanism assembly 68 is shown in a position when a lineman does not want solenoid 20 and vacuum interrupter 18 to reclose after a fault current occurs. In this position, handle mechanism 160 is maintained in the closed position, as described above, and lever 166 of lever mechanism 160 is rotated downwardly to a vertical lock-out position. This rotates lever 200 with respect to lever shaft 198 (seen in FIG. 9) to engage switch 204 which signals electronic control 22 to not reclose solenoid 20 and vacuum interrupter 18 if a fault occurs. Then if a fault occurs, electronic control 22 maintains solenoid 20 and vacuum interrupter 18 in the open position and signals solenoid assembly 172 to move handle mechanism 160 to the open position.

While a particular embodiment has been chosen to illustrate the invention, it will be understood by those skilled in the art that various changes and modifications can be made therein without departing from the scope of the invention as defined in the appended claims.

What is claimed is:

1. A recloser for use with an electrical power distribution system, comprising:

a circuit interrupter including a primary contact and a movable contact movable relative to said primary contact between a closed position allowing current to pass through said circuit interrupter and an open position separating said contacts and preventing current from passing through said circuit interrupter;

an actuator coupled to said circuit interrupter, said actuator including a movable shaft coupled to said movable contact of said circuit interrupter for substantially simultaneous movement therewith and without insulation being disposed between said movable contact and said movable shaft; and an electronic control electrically connected to said actuator, said electronic control communicating with said actuator upon occurrence of a fault current to trigger said shaft to move said movable contact of said circuit interrupter from said closed position to said open position and to trigger said shaft to reclose said movable contact from said open position to said closed position upon termination of the fault current, said circuit interrupter, said actuator, and said electronic control being ungrounded.

2. A recloser according to claim 1, wherein said actuator is a solenoid.

3. A recloser according to claim 1, wherein said actuator is located adjacent said circuit interrupter.

4. A recloser according to claim 1, wherein said circuit interrupter includes a dielectric housing enclosing said movable contact; each of said actuator and said electronic control are received in a housing with said dielectric housing connected to said housing of said actuator and said electronic control.

5. A recloser for use with an electrical power distribution system, comprising:

a circuit interrupter including a primary contact and a movable contact movable relative to said primary contact between a closed position allowing current to pass through said circuit interrupter and an open position separating said contacts and preventing current from passing through said circuit interrupter;

an actuator coupled to said circuit interrupter, said actuator including a movable shaft coupled to said movable contact of said circuit interrupter for substantially simultaneous movement therewith and without insulation being disposed between said movable contact and said movable shaft;

an electronic control electrically connected to said actuator, said electronic control communicating with said actuator upon occurrence of a fault current to trigger said shaft to move said movable contact of said circuit interrupter from said closed position to said oven position and to trigger said shaft to reclose said movable contact from said open position to said closed position upon termination of the fault current; and first and second terminals being electrically connected to each of said circuit interrupter and said electronic control, respectively, and adapted for electrical connection to the power distribution system, and defining a current path between said first terminal, said circuit interrupter, said electronic control and said second terminal, allowing current of the power distribution system to pass through said current path so that the potential of each of said circuit interrupter, said electronic control, and said second terminal, respectively, is the same as the potential of the power distribution system, and said first terminal, said circuit interrupter, said actuator, and said second terminal, being ungrounded.

6. A recloser for use with an electrical power distribution system, comprising:

a circuit interrupter including a primary contact and a movable contact movable relative to said primary contact between a closed position allowing current to pass through said circuit interrupter and an open position separating said contacts and preventing current from passing through said circuit interrupter;

an actuator coupled to said circuit interrupter, said actuator including a movable shaft coupled to said movable contact of said circuit interrupter for substantially simultaneous movement therewith and without insulation being disposed between said movable contact and said movable shaft; and an electronic control electrically connected to said actuator, said electronic control communicating with said actuator upon occurrence of a fault current to trigger said shaft to move said movable contact of said circuit interrupter from said closed position to said open position and to trigger said shaft to reclose said movable contact from said open position to said closed position upon termination of the fault current, said circuit interrupter, said actuator, and said electronic control not being received in a grounded container.

7. A recloser according to claim 1, wherein first and second terminals are electrically connected to said circuit interrupter and said electronic control, respectively, and are remote from one another, said first and second terminals are adapted for removable connection to the power distribution system allowing complete removal of said circuit interrupter, said actuator, and said electronic control from the power distribution system thereby providing a visible break in said current path.

8. A recloser according to claim 1, wherein said movable shaft and said movable contact are connected by a threaded connection; and said electrical control is coupled to said threaded connection by a conductive wire strap.

9. A recloser according to claim 1, wherein said circuit interrupter is a vacuum interrupter.

10. A recloser for use with an electrical power distribution system, comprising:

a circuit interrupter movable between a closed position allowing current to pass through said circuit interrupter and an open position preventing current from passing through said circuit interrupter;

an actuator coupled to said circuit interrupter and moving said circuit interrupter between said closed and open positions;

a rotatable handle mechanism coupled to said actuator and movable between first and second positions corresponding to said closed and open positions of said circuit interrupter, respectively; and an electronic control electrically connected to each of said actuator and said handle mechanism for said electronic control to trigger said actuator to move said circuit interrupter from said closed position to said open position and for said handle mechanism to trigger said electronic control to cause said actuator to move said circuit interrupter from said open position to said closed position upon movement of said handle from said second position to said first position, said circuit interrupter, said actuator, said electronic control, and said handle mechanism being ungrounded, said handle mechanism upon movement from said second position to said first position being incapable of mechanically moving said circuit interrupter to said closed position.

11. A recloser according to claim 11, wherein said circuit interrupter includes a primary contact and a movable contact movable relative to said primary contact between said closed position with said contacts being in contact and said open position with said contacts being separated;

said actuator includes a shaft coupled to said movable contact for substantially simultaneous movement with said movable contact; and said handle mechanism is coupled to said shaft for mechanically moving said actuator from said closed position to said open position.

12. A recloser for use with an electrical power distribution system, comprising:

a circuit interrupter including a primary contact and a movable contact movable relative to said primary contact between a closed position with said contacts being in contact thereby allowing current to pass through said circuit interrupter and an open position with said contacts being separated thereby preventing current from passing through said circuit interrupter;

an actuator coupled to said circuit interrupter and moving said circuit interrupter between said closed and oven positions, said actuator including a shaft coupled to said movable contact for substantially simultaneous movement with said movable contact, said shaft including a catch;

a rotatable handle mechanism coupled to said shaft for mechanically moving said actuator between first and second positions corresponding to said closed and open positions of said circuit interrupter, respectively, said handle mechanism upon movement from said second position to said first position being incapable of mechanically moving said circuit interrupter to said closed position, said handle mechanism including a bracket slidably coupled to said shaft allowing said shaft to slide between said closed and open positions, said catch on said shaft engaging said bracket when said handle mechanism is mechanically moved from said first position to said second position to move said actuator mechanically from said closed position to said open position without operation of said electronic control; and an electronic control electrically connected to each of said actuator and said handle mechanism for said electronic control to trigger said actuator to move said circuit interrupter from said closed position to said oven position and for said handle mechanism to trigger said electronic control to cause said actuator to move said circuit interrupter from said oven position to said closed position upon movement of said handle from said second position to said first position.

13. A recloser according to claim 10, wherein said electronic control recloses said actuator and said circuit interrupter from said open position to said closed position without actuation of said handle mechanism.

14. A recloser according to claim 10, wherein said electronic control substantially simultaneously triggers said actuator to move said circuit interrupter from said closed to said open position and moves said handle mechanism from said first position to said second position during permanent fault conditions.

15. A recloser according to claim 10, wherein said actuator is disposed adjacent said circuit interrupter without insulation disposed therebetween.

16. A recloser for use with an electrical power distribution system, comprising:

a circuit interrupter movable between a closed position allowing current to pass through said circuit interrupter and an open position preventing current from passing through said circuit interrupter;

an actuator coupled to said circuit interrupter and moving said circuit interrupter between said closed and open positions;

a rotatable handle mechanism coupled to said actuator and movable between first and second positions corresponding to said closed and open positions of said circuit interrupter, respectively, said handle mechanism upon movement from said second position to said first position being incapable of mechanically moving said circuit interrupter to said closed position;

an electronic control electrically connected to each of said actuator and said handle mechanism for said electronic control to trigger said actuator to move said circuit interrupter from said closed position to said open position and for said handle mechanism to trigger said electronic control to cause said actuator to move said circuit interrupter from said open position to said closed position upon movement of said handle from said second position to said first position; and a lever mechanism separate from said handle mechanism is electrically connected to said electronic control for preventing said electronic control from triggering said circuit interrupter and said actuator to reclose from said open position to said closed position.

17. A recloser according to claim 16, wherein said lever mechanism includes a lever and a rotatable shaft whereby rotating of said lever and said rotatable shaft triggers said electronic control to prevent said circuit interrupter and said actuator from reclosing from said open position to said closed position.

18. A recloser according to claim 10, wherein said electronic control is electrically connected to said handle mechanism through limit switches.

19. A recloser according to claim 1, wherein first and second terminals are electrically connected to each of said circuit interrupter and said electronic control, respectively, and adapted for electrical connection to the power distribution system, and define a current path between said first terminal, said circuit interrupter, said electronic control and said second terminal, allowing current of the power distribution system to pass through said current path so that the potential of each of said circuit interrupter, said electronic control, and said second terminal, respectively, is the same as the potential of the power distribution system.

20. A recloser according to claim 5, wherein said circuit interrupter includes a dielectric housing enclosing said movable contact; and each of said actuator and said electronic control are received in a housing with said dielectric housing connected to said housing of said actuator and said electronic control.

21. A recloser according to claim 5, wherein said first and second terminals are remote from one another, and said first and second terminals are adapted for removable connection to the power distribution system allowing complete removal of said circuit interrupter, said actuator, and said electronic control from the power distribution system thereby providing a visible break in said current path.

22. A recloser according to claim 5, wherein said movable shaft arid said movable contact are connected by a threaded connection; and said electrical control is coupled to said threaded connection by a conductive wire strap.

23. A recloser according to claim 5, wherein said circuit interrupter is a vacuum interrupter.

24. A recloser according to claim 6, wherein said circuit interrupter, said actuator, and said electronic control are ungrounded.

25. A recloser according to claim 6, wherein said circuit interrupter includes a dielectric housing enclosing said movable contact; and each of said actuator and said electronic control are received in a housing with said dielectric housing connected to said housing of said actuator and said electronic control.

26. A recloser according to claim 6, wherein first and second terminals are electrically connected to said circuit interrupter and said electronic control, respectively, and are remote from one another, said first and second terminals are adapted for removable connection to the power distribution system allowing complete removal of said circuit interrupter, said actuator, and said electronic control from the power distribution system thereby providing a visible break in said current path.

27. A recloser according to claim 6, wherein said movable shaft and said movable contact are connected by a threaded connection; and said electrical control is coupled to said threaded connection by a conductive wire strap.

28. A recloser according to claim 6, wherein said circuit interrupter is a vacuum interrupter.

29. A recloser according to claim 10, wherein a lever mechanism separate from said handle mechanism is electrically connected to said electronic control for preventing said electronic control from triggering said circuit interrupter and said actuator to reclose from said open position to said closed position.

30. A recloser according to claim 29, wherein said lever mechanism includes a lever and a rotatable shaft whereby rotating of said lever and said rotatable shaft triggers said electronic control to prevent said circuit interrupter and said actuator from reclosing from said open position to said closed position.

31. A recloser according to claim 11, wherein said handle mechanism includes a bracket slidably coupled to said shaft allowing said shaft to slide between said closed and open positions; and said shaft includes a catch that can engage said bracket when said handle mechanism is mechanically moved from said first position to said second position to move said actuator mechanically from said closed position to said open position without operation of said electronic control.

32. A recloser according to claim 12, wherein said circuit interrupter, said actuator, and said electronic control are ungrounded.

33. A recloser according to claim 12, wherein said electronic control recloses said actuator and said circuit interrupter from said open position to said closed position without actuation of said handle mechanism.

34. A recloser according to claim 12, wherein said electronic control substantially simultaneously triggers said actuator to move said circuit interrupter from said closed to said open position and moves said handle mechanism from said first position to said second position during permanent fault conditions.

35. A recloser according to claim 12, wherein said actuator is disposed adjacent said circuit interrupter without insulation disposed therebetween.

36. A recloser according to claim 16, wherein said circuit interrupter, said actuator, and said electronic control are ungrounded.

37. A recloser according to claim 16, wherein said electronic control recloses said actuator and said circuit interrupter from said open position to said closed position without actuation of said handle mechanism.

38. A recloser according to clam 16, wherein said electronic control substantially simultaneously triggers said actuator to move said circuit interrupter from said closed to said open position and moves said handle mechanism from said first position to said second position during permanent fault conditions.

39. A recloser according to claim 16, wherein said actuator is disposed adjacent said circuit interrupter without insulation disposed therebetween.

* * * * *